US008567505B2

(12) United States Patent
Davidson

(10) Patent No.: US 8,567,505 B2
(45) Date of Patent: Oct. 29, 2013

(54) INJECTION OF LIQUID INTO BOREHOLES, WITH SUCKBACK PULSING

(75) Inventor: Brett Charles Davidson, Cambridge (CA)

(73) Assignee: Wavefront Reservoir Technologies Ltd., Cambridge, Ontario (CA)

( * ) Notice: Subject to any disclaimer, the term of this patent is extended or adjusted under 35 U.S.C. 154(b) by 449 days.

(21) Appl. No.: 13/120,271

(22) PCT Filed: Sep. 24, 2009

(86) PCT No.: PCT/CA2009/001333

§ 371 (c)(1),
(2), (4) Date: Mar. 22, 2011

(87) PCT Pub. No.: WO2010/034113

PCT Pub. Date: Apr. 1, 2010

(65) Prior Publication Data

US 2011/0259575 A1 Oct. 27, 2011

(30) Foreign Application Priority Data

Sep. 24, 2008 (GB) ..... 0817500.2

(51) Int. Cl.
*E21B 34/14* (2006.01)

(52) U.S. Cl.
USPC ..... 166/319; 166/305.1; 166/373; 166/386

(58) Field of Classification Search
USPC ..... 166/373, 386, 319, 305.1, 249
See application file for complete search history.

(56) References Cited

U.S. PATENT DOCUMENTS

| | | | | |
|---|---|---|---|---|
| 5,836,393 | A * | 11/1998 | Johnson | 166/308.1 |
| 6,241,019 | B1 | 6/2001 | Davidson et al. | |
| 6,405,797 | B2 | 6/2002 | Davidson et al. | |
| 6,851,473 | B2 | 2/2005 | Davidson | |
| 8,061,421 | B2 * | 11/2011 | Samaroo et al. | 166/177.5 |
| 2005/0189108 | A1 | 9/2005 | Davidson | |

FOREIGN PATENT DOCUMENTS

| | | |
|---|---|---|
| GB | 2412675 | 10/2005 |
| WO | WO2007/100352 | 9/2007 |
| WO | WO2008/037069 | 4/2008 |
| WO | WO2009/089622 | 7/2009 |

* cited by examiner

*Primary Examiner* — David Andrews
*Assistant Examiner* — Catherine Loikith
(74) *Attorney, Agent, or Firm* — Anthony Asquith Corp.

(57) ABSTRACT

When injecting liquids into the ground, imposing pulses on the injected liquid is effective to increase penetration and saturation of the ground. Imposing suckback onto the pulses is effective to make the liquid in the ground behave as a coherent unitary body, surging out and back each pulse, and to super-saturate the ground. The tool includes a suckback-chamber, which is timed to open to the ground formation just as the pulse-valve closes. A biasser (e.g a spring) drives the chamber open and sucks in some of the liquid from the ground. The chamber is then emptied, back to the ground, by the rising pressure as the pulsing tool is recharged. The suck-back-chamber can be added to any type of pulsing tool.

13 Claims, 4 Drawing Sheets

INJECTION OF LIQUID INTO BOREHOLES, WITH SUCKBACK PULSING

The technology disclosed in this specification is a development of the technology shown in patent publication U.S. Pat. No. 6,851,473 (Davidson, 8 Feb. 2005).

One of the problems with simple (i.e non-pulsed) injection of liquid into the ground is that the liquid penetrates and spreads very unevenly. The injected liquid tends to extend outwards into the ground, not as a uniform front advancing circumferentially outwards from the borehole, but as fingers of liquid, which follow the existing pathways in the ground of (slightly) lower permeability—unfortunately in such manner as to lower still further the already-lower resistance of those pathways.

Introducing almost any type of pulsing to the injected liquid is likely to be beneficial, in that pulsing tends to reduce the degree of fingering. Often, applying pulses to the pressurized liquid enables the liquid to be injected into the ground at a greater rate.

Of course, the engineers could inject more liquid, and could inject it at a faster rate, simply by raising the injection pressure. However, there is usually a limitation, often imposed by regulation for the purpose of avoiding physical damage to the ground, as to the maximum pressure at which fluids can be injected into the particular ground formation. Generally, the engineers, motivated to inject as much liquid into the ground as possible, and to inject it as quickly as possible, wish to use the highest possible injection pressure. Pulsing the injection generally enables more liquid to be injected at the allowed pressure.

As injection continues, and more liquid enters the ground, so the back pressure of the ground, i.e the pressure that resists further injection, rises. Thus, after a period of injection, as the formation becomes saturated with the injected liquid, the available pressure differential between the liquid being injected and the ground becomes smaller. Pulsing enables the saturation state of the ground to be increased: where injection-without-pulsing can saturate the formation, injection-with-pulsing can be expected to over-saturate the formation.

In injection-with-pulsing, a pulse-valve of the pulse-injection tool is opened, and a charge-volume of liquid is injected out of the tool, into the ground. The opening of the pulse-valve defines the injection-phase of the pulse-cycle. During the injection-phase, the charge-volume passes from an accumulator of the tool out into the formation, whereby the accumulator-pressure within the tool starts to fall. The formation-pressure starts to rise, as liquid is injected into the formation. The pressure differential between the accumulator-pressure and the formation-pressure is herein termed the PDAF. During the injection-phase, the PDAF is decreasing.

Later, the pulse-valve closes, which defines a recovery or recharge-phase of the pulse-cycle. During the recharge-phase, the accumulator is recharged with pressurized liquid (from the surface), whereby the accumulator-pressure inside the tool now increases. At the same time, during the recharge-phase, no more liquid is being injected, and the just-injected liquid is dissipating into the ground and so the formation-pressure is falling. Thus, during the recharge-phase, the PDAF is increasing.

Pulsing with suckback is especially efficacious from the standpoint of homogenizing the ground formation. Pulsing with suckback can be expected to super-saturate the formation around the injection well. In pulsing-with-suckback, a suckback-chamber is created inside the tool, which is open to the formation during the recharge-phase of the injection-cycle. At this time, the pressure in the suckback-chamber is lower than the formation-pressure, and the chamber is open to the formation. Therefore, some liquid is sucked back into the chamber, from the formation. This suckback of (some of) the just-injected liquid has been found to be very effective in increasing the amount of, and the rate at which, liquid that can be injected into the ground, for a given maximum allowed pressure.

Adding suckback to the pulses can be expected to make a significant reduction in the degree and effect of fingering, and to reducing the in-ground gradients of many in-ground parameters, including gradients of permeability, porosity, liquid-content, contaminant concentration, and so forth.

One of the especial benefits of suckback is an enhanced ability to procure the conditions under which the liquid in the ground around the borehole becomes a coherent unitary body of liquid. That is to say, during the injection-phase of the pulse-cycle, the in-ground body of liquid surges outwards, away from the borehole, as a coherent unitary body. During the suckback portion of the recharge-phase of the cycle, if the proper conditions can be established, the same coherent unitary body of liquid surges back towards the borehole.

Such out-and-back movement of a coherent unitary body of liquid, in time with the pulses, is enormously effective in homogenizing the in-ground liquid, and indeed, sometimes, in homogenizing the ground itself. When the coherent body of liquid can be established, generally fingering can be reduced to the point that it is eliminated as a problem.

In some designs of pulsing-tool, suckback is inherent, i.e it happens automatically. However, there is usually a problem with the tools in which suckback is inherent, as will now be described.

A pulse-injection tool has a movable pulse-valve-member, which moves relative to a pulse-valve-housing to open and close the pulse-valve. The movement of the pulse-valve-member is activated by a pulse-valve-driver. The driver can be unitary with the member, or can be separate from the member. When the driver is separate from the member, they are connected by a pulse-valve-connector. The pulse-valve-connector permits the driver to travel, during an opening or closing movement of the pulse-valve, a further distance than the member, and the extra distance may be used to ensure that the pulse-valve opens rapidly—even violently rapidly.

Such rapidity of opening can be useful in generating an energetic porosity-wave, which propagates out into the ground formation. An energetic porosity-wave can extend the penetrative power of the pulsing action out into the formation, especially when the ground is approaching the super-saturation condition, and the coherent body of liquid which surges out-and-back, has been established.

However, designing the tool to produce an energetic porosity-wave can mean that the seals of the tool have a short service life, in that the seals have to cope with very rapid speeds of movement. One of the benefits of the present technology is that it enables the suckback components to be separated from the pulse-valve opening and closing components, and it thus enables both to be designed without having to be compromised by the needs of the other. By separating the suckback-chamber and associated components from the pulse-valve components, in the manner as described herein, the seals on the pulse-valve components need not be compromised by having to travel over a long distance, or by having to move very rapidly, or by having to sweep over sharp-edged ports and windows.

As mentioned, in some designs of pulse-injection tool, suckback is inherent. It is inherent when the movable pulse-valve-member, or the pulse-valve-driver connected thereto, carries on travelling in the pulse-valve closing direction, even after the pulse-valve is closed. Such movement creates an empty space, and, in order for suckback to occur, such space is arranged to be open to the ground formation. The said empty space created by the movement of the suckback-piston is open to the formation-space 32 outside the tool, and thus is open (via suitable perforations in the well-casing) to the formation. When such over-travel of the pulse-valve-driver (i.e travel beyond the pulse-valve-closed condition) is present, the tool can be arranged so that liquid is sucked back out of the formation, into the space, during the recovery or recharge-phase of the pulse-cycle, whereby the space serves as a suckback-chamber.

The present technology enables suckback to be present in those designs of pulse-injection tool in which there is no inherent suckback, or in which the inherent suckback produces only a small suckback volume. Also, the present technology provides an alternative to those designs in which, although suckback is procured, it is procured at the expense of e.g service-life problems, especially of the elastomeric seals.

In the present technology, in order to create the desired suckback-chamber, the designers preferably provide a suckback-piston and a complementary cylinder. The suckback-piston moves between a rest-position and a suckback-position. The designers' task is to engineer a manner of operating the suckback-piston whereby, during the recovery-stroke of the injection-cycle, the suckback-piston moves from its rest-position to its suckback-position, thus creating the said empty volume.

The designers should see to it that the suckback-piston moves to its suckback-position and then is returned to its rest-position before the start of the recovery-stroke of the next injection-cycle. Preferably, the suckback-piston should resume its rest-position before the start of the injection-stroke of the next cycle.

In the accompanying drawings:

FIG. 1 is a cross-section of a down-hole apparatus that has been engineered to create suckback.

FIGS. 1*a*,1*b*,1*c*,1*d* show the same apparatus as FIG. 1 at different points of the injection cycle.

FIG. 2 is a cross-section of another down-hole apparatus that has been engineered to create suckback.

FIG. 2*a* shows the same apparatus as FIG. 2 at a different point of its injection cycle.

The scope of the patent protection sought herein is defined by the accompanying claims, as submitted and amended, and not necessarily by particular features of the exemplary tools, as disclosed.

Figure 1:
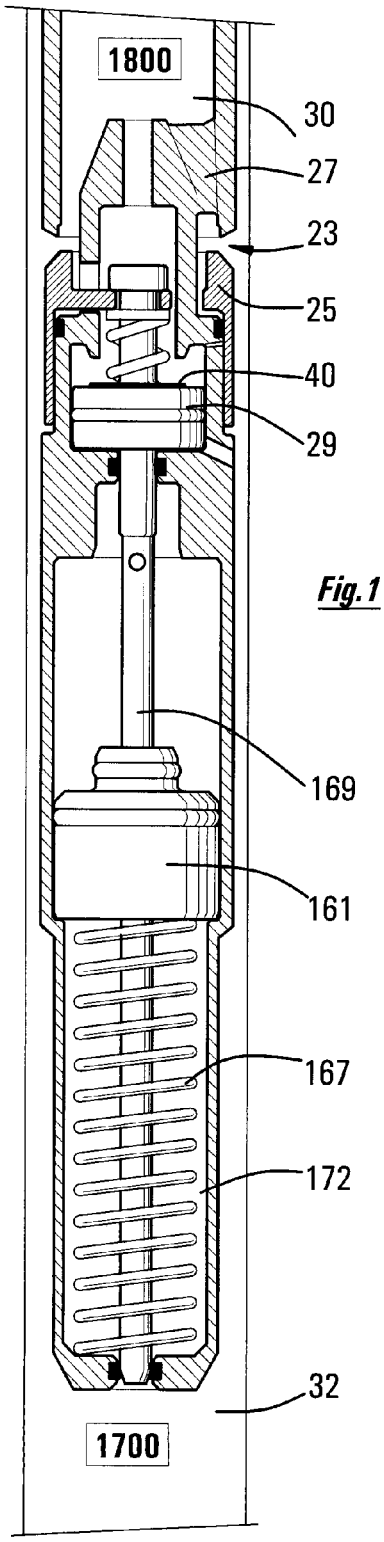

The tool shown in FIG. 1 includes a pulse-valve 23. The pulse-valve includes a pulse-valve-member 25, which slides up/down relative to the housing 27 of the tool, between a pulse-valve-closed (up) position and a pulse-valve-open (down) position. The pulse-valve-member 25 is connected to a pulse-valve-driver, which in this case takes the form of a hammer-piston 29.

There is a lost motion connection between the member 25 and the hammer-piston 29. In FIG. 1, the pulse-valve-member 25 is down and the pulse-valve 23 is open. Liquid is pouring out through the open pulse-valve from the accumulator-space 30, into the formation-space 32 outside the tool, and out through perforations (not shown) in the well-casing, into the ground-formation surrounding the well. To close the pulse-valve, the hammer-piston 29 moves upwards, taking the valve-member 25 with it. The valve-member 25 contacts the pulse-valve-seat formed in the tool housing 27. The hammer-piston 29 then continues its upwards movement, leaving the valve-member 25 stationary.

Figure 1A:
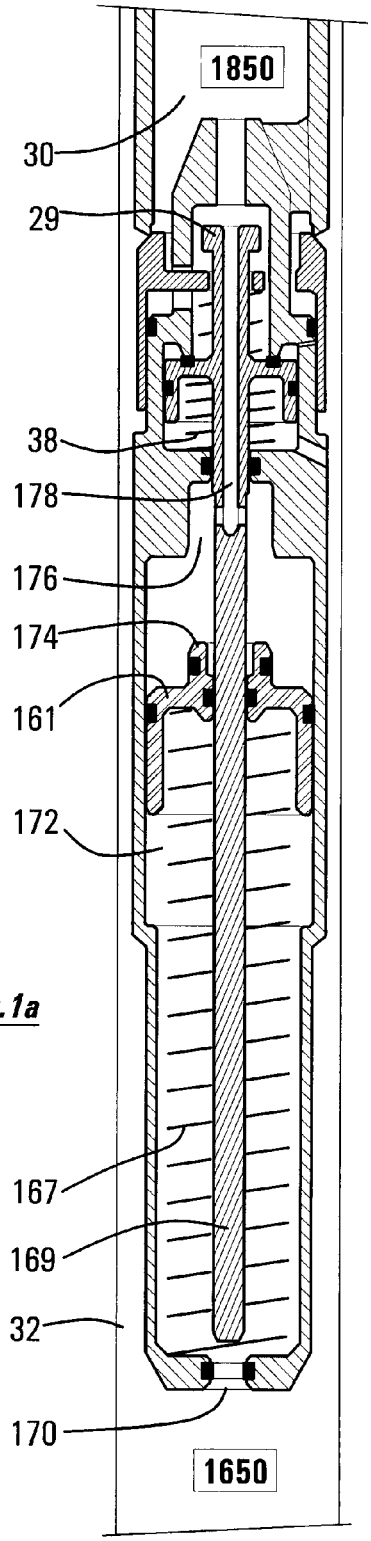

FIG. 1*a* shows the locations of the pulse-valve components 25,29 when the pulse-valve 23 is closed. The valve-member 25 and the hammer-piston 29 are at the tops of their respective travels.

The hammer-piston 29 is acted upon by the difference in pressure between the accumulator-pressure in the accumulator-space 30 and the formation-pressure in the formation-space 32, i.e by the PDAF. The accumulator pressure is larger than the formation-pressure during cyclic operation, and so the PDAF acts to urge the hammer-piston 29 downwards.

The hammer-piston 29 is biassed in the upwards direction by a piston-spring 38. When the pulse-valve 23 is open, the PDAF is falling. When the PDAF drops down to its low-threshold level, the spring-force is now greater than the PDAF-force on the piston, whereby the piston rises, thereby closing the pulse-valve. The engineer can pre-determine the low-threshold level of the PDAF, at which the pulse-valve closes, by selecting a suitable magnitude of the force exerted by the spring, in conjunction with the areas of the piston that are exposed to the various pressures.

(The over-travel of the pulse-valve-driver, or hammer-piston 29, i.e its travel beyond the point at which the pulse-valve-member 25 engages the pulse-valve-seat in the housing, creates a space underneath the piston 29. This space is open to the formation-space 32, but closed to the accumulator space 30. Therefore, while the PDAF is low, liquid is sucked into the chamber, from the ground formation. Such flow of liquid back from the formation constitute suckback. However, the volume of liquid sucked back is tiny, in this case, because the over-travel of the piston 29 is tiny. The tiny travels of the piston 29 and of the pulse-valve-member 25 mean that the elastomeric seals thereon can be expected to have a reasonable service life. The present technology is concerned with creating much larger volumes of suckback, but without compromising those valve seals.)

In the example, the pulse-valve has been set to close at a low-threshold level of the PDAF of 100 psi. In FIG. 1, the accumulator-pressure has fallen to the 1800 psi, and the formation-pressure has risen to 1700 psi, whereby the PDAF is 100 psi. Now the spring-force takes over, and closes the pulse-valve 23.

The pulse-valve 23 being now closed, in FIG. 1*a*, the PDAF starts to rise. The accumulator-pressure in the space 30 starts to increase (to 1850 psi in FIG. 1*a*), and the formation-pressure in the space 32 starts to decrease (to 1650 psi in FIG. 1*a*), whereby the PDAF has risen to 200 psi.

The recharge-phase of the pulse-cycle is complete when the PDAF reaches its high-threshold level. The designers of the tool have set the high-threshold level of the PDAF at 500 psi. This is the level at which the force on the hammer-piston 29 due to the pulse-valve-biassing-spring 38 is balanced by the PDAF acting over the small area-AS enclosed by the seal 40 of the hammer-piston 29. In FIG. 1*d*, just as the PDAF reaches 500 psi, the seal 40 cracks open. The full area-AF of the hammer-piston is now, suddenly, exposed to the high accumulator-pressure, and the hammer-piston 29 slams downwards.

The valve-member 25 is caught up by the rapid movement of the piston 29, and the pulse-valve slams open. The lost-motion connection between the pulse-valve-member 25 and the hammer-piston 29 means that the (heavy) piston 29 is already travelling at a high rate of speed at the moment the piston slams into the valve-member 25. The pulse-valve 23 therefore opens very rapidly indeed, thereby creating the energetic porosity wave.

During the injection-phase of the pulse-cycle, the pulse-valve 23 remains open. The charge-volume of liquid is injected out into the formation, until the PDAF once more falls to 100 psi. Then, the pulse-valve closes, and the cycle continues.

The operation of the suckback components of the tool of FIG. 1 will now be described.

In FIG. 1, the tool is shown nearing the end of the injection-stroke of its pulse-cycle. The hammer-piston 29 is DOWN, the pulse-valve 23 is open, and liquid is being injected, still under pressure, into the formation. In FIG. 1*a*, the PDAF has fallen to its minimum value, 100 psi in this case, and the pulse-valve has closed. As shown in FIG. 1, the suckback-piston 161 is DOWN, or in its rest-position.

A rod 169 is unitary with the hammer-piston 29. When the hammer-piston rose, and closed the pulse-valve 23, the rod 169 also rose. In the FIG. 1 position, the rod 169 held the suckback-port 170 closed, but in FIG. 1*a*, the suckback-port 170 is now open. Thus, in FIG. 1, the suckback-piston 161 was held in its DOWN position, because the suckback-piston was subjected to the full 1800 psi of the accumulator pressure. The pressure below the suckback-piston at this time was effectively zero, since the suckback-port 170 was closed.

But now, in FIG. 1*a*, the rod 169 having moved upwards with the hammer-piston, the suckback-port 170 is open. The suckback-chamber 172 underneath the suckback-piston 161 is now open to the liquid in the formation-space 32. The suckback-piston 161 thus becomes subjected to a downwards force due to the pressure differential PDAF. At the same time, the suckback-piston is subjected to an upwards force arising from the suckback-biassing-spring 167.

In FIG. 1*a*, the pulse-valve has just closed, and the recharge-phase has just begun, so the PDAF at this point is still at, or near, its low-threshold level of 100 psi, being 200 psi in FIG. 1*a*. The suckback-piston 161 therefore rises, as shown in FIG. 1*a*. The suckback-piston 161 is free-floating, and can move up/down axially relative to the rod 169.

The designers have so arranged the dimensions of the components, and the strengths of the springs, that, in FIG. 1*a*, the suckback-spring 167 drives the suckback-piston 161 upwards, away from its DOWN or rest-position. As the suckback-piston 161 rises, the volume of the suckback-chamber 172 below the suckback-piston 161 increases.

In FIG. 1*a*, the pulse-valve 23 is closed. Therefore, the increasing volume of the suckback-chamber 172 cannot be filled with liquid from the accumulator, i.e from the space 30. The suckback-chamber 172 is at a lower pressure than the formation-pressure in the formation outside the well, whereby the rising of the suckback-piston 161 draws (sucks) liquid back in from the formation-space 32, during the recovery-stroke of the pulse-cycle.

In FIG. 1*a*, the suckback-piston 161 rises very rapidly, as soon as the suckback-port 170 opens, i.e before the pressure in the accumulator-space 30 has barely started to rise, and is still at, or hardly above, 1800 psi—say at 1850 psi. It can be expected that, in FIG. 1*a*, the pressure in the formation-space 32 now has fallen a little—e.g to 1650 psi. Thus, the PDAF is 200 psi in FIG. 1*a*.

Figure 1B:
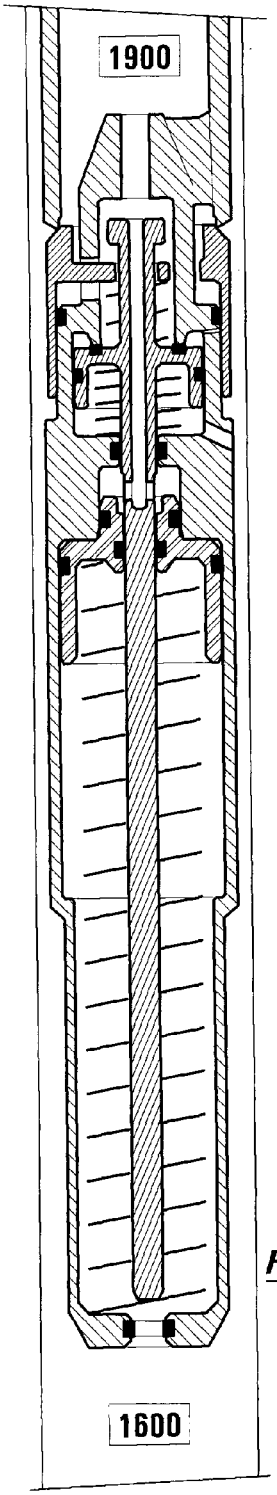

The suckback-piston 161 moves upwards until the nose 174 of the piston enters the recess 176, and the piston abuts against the body of the tool, as shown in FIG. 1*b*. (The pressure in the recess 176 is equal to accumulator pressure, by virtue of the passageway 178 through the hammer-piston 29.)

In FIG. 1*b*, the pressure in the accumulator-space 30 has risen now to 1900 psi, and the pressure in the formation-space 32 has fallen to 1600 psi. Thus, in FIG. 1*b*, the PDAF has now increased to 300 psi. (These pressure levels have been given numbers for explanatory or illustrative purposes; it should not be expected that the increase in the accumulator-pressure would actually exactly mirror the decrease in formation-pressure.)

The designers preferably should arrange for the suckback-piston 161 to remain in its UP position for long enough to ensure that the suckback portion of the cycle can take place, preferably before the end of the recovery-stroke. (The end of the recovery-stroke is the same event as the beginning of the injection-stroke, being triggered by the descent of the piston-hammer 29, and the opening of the pulse-valve 23.) On the other hand, the designers preferably should ensure that the suckback-piston 161 has returned to its $_{DOWN}$ position before the hammer 29 actually starts to move downwards. Thus, where the designers have arranged for the valve-opening movement of the hammer to be triggered by the PDAF going above 500 psi, preferably they should arrange for the suckback-piston to descend to its DOWN position at a PDAF of, say, 400 psi.

Figure 1C:
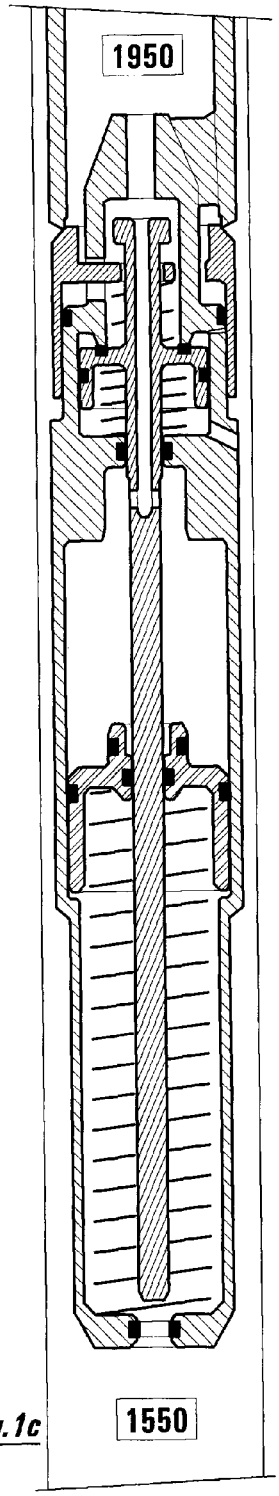
Figure 1D:
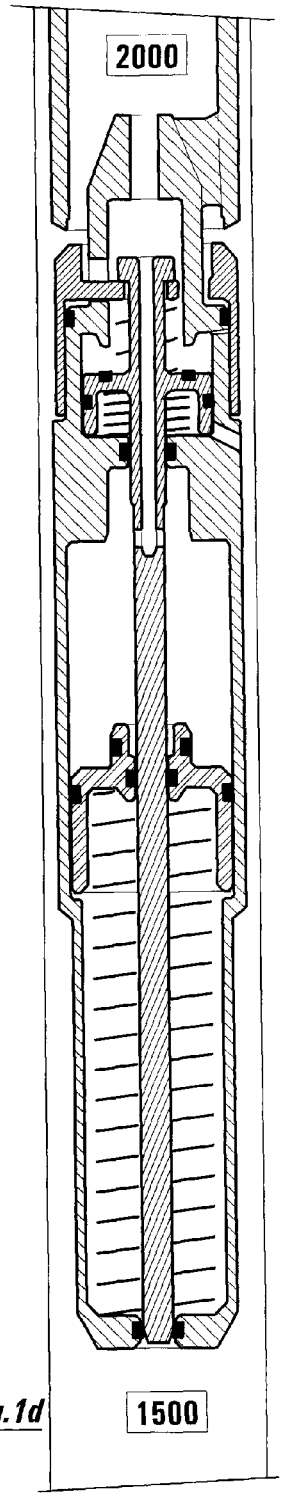

FIGS. 1*b*,1*c* show what happens when the PDAF increases to 400 psi. In FIG. 1*b*, the pressure in the accumulator-space 30 acts only upon the nose 174 of the suckback-piston 161, since the nose is sealed into the recess 176. The pressure in the suckback-chamber 172 below the suckback-piston (which is equalized to the formation-pressure) acts over the whole area of the suckback-piston. Therefore, the PDAF must increase to a comparatively high level in order to create enough downwards force on the suckback-piston 161 to overcome the upwards force due to the suckback-spring 167.

As mentioned, it is arranged that the suckback-piston moves downwards when the PDAF reaches its suckback-equalization level of e.g 400 psi, which is the condition shown in FIG. 1*c*. Once the suckback-piston 161 has started to move downwards, now the nose 174 moves clear of the recess 176, whereby the PDAF now suddenly acts over the whole area of the suckback-piston—causing the suckback-piston 161 to return to its DOWN position very smartly.

It is preferred that the suckback-piston be fully restored to its DOWN position (FIG. 1*c*) before the pulse-valve opens, at the beginning of the injection-stroke. It should be noted that this timing is not essential to the suckback function, as such. The timing of the movements of the suckback-piston will be considered in more detail later.

In FIG. 1*c*, the tool is now in condition for the PDAF to continue to rise to 500 psi. At that, the PDAF-force overcomes the hammer-spring 38, and the hammer-piston 29 will once again descend, and open the pulse-valve, and trigger the start of a fresh injection-stroke.

In FIG. 1*d*, the PDAF has reached 500 psi; the hammer-piston 29 has descended, opening the pulse-valve 23, and a new pulse-cycle has started, with a new injection-stroke. During and throughout the injection-stroke, the suckback components remain in the positions shown in FIG. 1*d*. When, following the injection of the charge-volume, the PDAF has fallen to 100 psi, the injection-stroke ends, and a new recovery-stroke begins.

The operation of the rod 169 in conjunction with the suckback-port 170 will now be considered in more detail.

It might be considered that the rod 169/port 170 provision is not required, and that the suckback-chamber 172 underneath the suckback-piston 161 could simply be connected to the formation-space 32 all the time. And in some applications, that arrangement might be adequate. However, in that case, it would be difficult for the designers to arrange for the suckback-piston not to rise, i.e to remain DOWN, until the pulse-valve closes. If the suckback-piston were to rise while the pulse-valve is still open, i.e before the end of the injection-stroke, the expanding chamber 172 would be filled with liquid from the accumulator, not from the formation—which would negate the suckback effect. The rod/port provision means that the suckback-piston 161 advantageously cannot start to rise until the moment the pulse-valve closes.

At the time (FIG. 1) the suckback-piston 161 is being called upon to rise, the PDAF is at its low-threshold, or smallest magnitude (100 psi) and therefore the PDAF poses only a minimum resistance against the upwards-driving effect of the suckback-spring 167. Therefore, the presence of the rod/port combination also means that, once the pulse-valve does close, and the suckback-port 170 does open (FIG. 1*a*), the suckback-piston rises immediately and forcefully to the top of its travel, i.e to the FIG. 1*b* position.

The designers also desire to have close control over the moment when the suckback-piston 161 descends. As mentioned, the designers should see to it that the suckback-piston 161 is fully descended before the pulse-valve opens (as shown in FIG. 1*c*). But at the same time, the designers also wish to leave the suckback-piston 161 in its UP position as long as possible, to ensure that all the liquid that can flow back from the formation back into the borehole, and back into the suckback-chamber 172, is not prevented from doing so simply by a lack of time.

It should be understood that, in some applications of the tool, in an actual well, the pressure differential available for driving the reverse suckback flow of liquid can be quite small. However, the suckback flow, in order to perform its useful function, does not need to be of large velocity nor of large volume; it is the fact that the flow is (substantially) reversed, at all, that gives rise to most of the advantageous effect. Often, the volume sucked back into the tool need not be more than a few liters, in order for the suckback effect to be significantly advantageous. The volume sucked back, per cycle, can be equated, at least theoretically-arithmetically, to the change in the volume of the suckback-chamber 172.

In the example, the provision of the nose 174 and recess 176 enables the designers to control the moment the suckback-piston starts to descend. If the nose-recess were not provided, the suckback-piston would simply be subjected to the PDAF over its full area, above and below, whereby the piston would descend as soon as the PDAF had risen (during the recovery-stroke) to a level at which the PDAF could overcome the suckback-spring 167. The nose/recess provision is a way of increasing the equalization level of the PDAF (at which the PDAF-force on the piston equals the spring-force on the piston) without resorting to a very powerful spring. The nose/recess provision also means that, once the piston has started to descend, it moves quickly (i.e it snaps back) to its DOWN (FIG. 1*d*) position.

The annular space around the recess 176 should be vented to the formation-space 32 outside the tool. Theoretically, it would be desirable for the suckback-spring 167 to exert a constant force—but of course the spring-force will be greater when the suckback-piston is DOWN; however, the designers should seek to keep the spring-rate of the suckback-spring to a low value.

Generally, in order to secure a low spring-rate, the designers will have to allow for the suckback-spring 167 to be physically long, i.e long in the axial or vertical direction—perhaps e.g two meters long in some cases. Of course, in a borehole or well, it is often not difficult to provide for the suckback-spring to be long—since, in a down-hole apparatus, although diametral space is at a critical premium, vertical length is not.

In an alternative apparatus, there is provided, in place of (or in addition to) the suckback-spring 167, a suckback-accumulator of the gas-filled type. The designers arrange for the force provided by the suckback-accumulator to carry out the same or equivalent functions as the force provided by the suckback-spring, in that they arrange for:

- the suckback-accumulator to be triggered to drive the suckback-piston upwards preferably simultaneously with, or just after, the closing of the pulse-valve;
- the suckback-piston to be fully restored to its DOWN position, preferably before the pulse-valve re-opens; and
- the suckback-accumulator to be re-charged.

The suckback-accumulator, when provided, can be re-charged by using pressure from the main accumulator, or directly from the source (at the surface) from which the main accumulator is re-charged.

Figure 2:
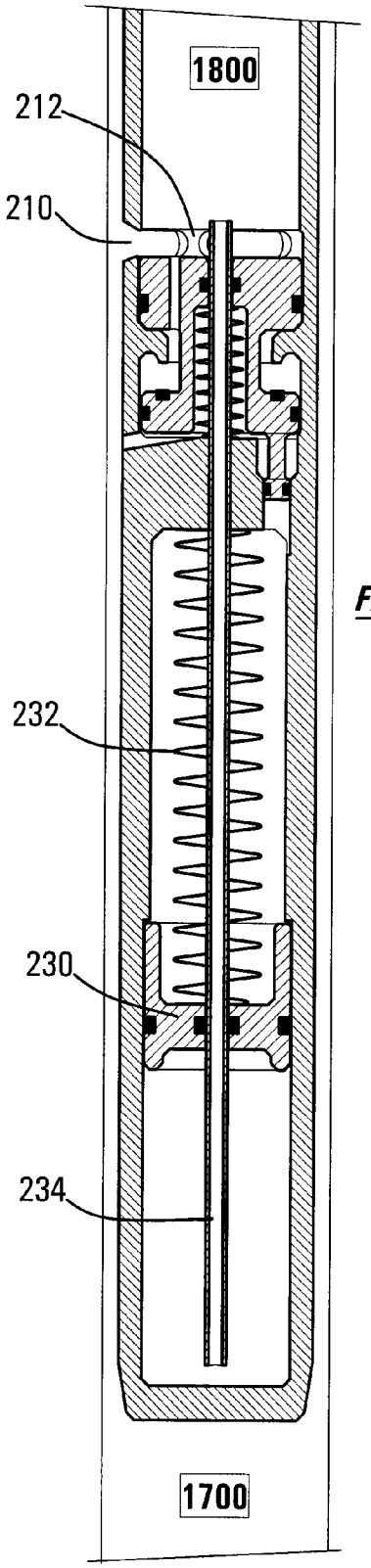

The design shown in FIG. 2 follows the preference designers sometimes have to locate all the moving components of the pulse-valve on the inside of the tubular housing of the tool. When this is done, the pulse-valve port 210 cannot be a complete open circle, of course, because the portions of the housing above the pulse-valve-port must still be mechanically unitary with the housing below the port. However, the disadvantage of the presence of "spokes" 212 bridging across the pulse-valve port 210 is offset by the less complicated internal structure within the tool.

The FIG. 2 design also follows the preference designers sometimes have not to provide a separate hammer, but rather to combine the movable pulse-valve-member with the hammer or hammer-piston, as one unitary component. In the tool of FIG. 2, both these preferences have been followed, and yet a suckback facility still has been provided.

Figure 2A:
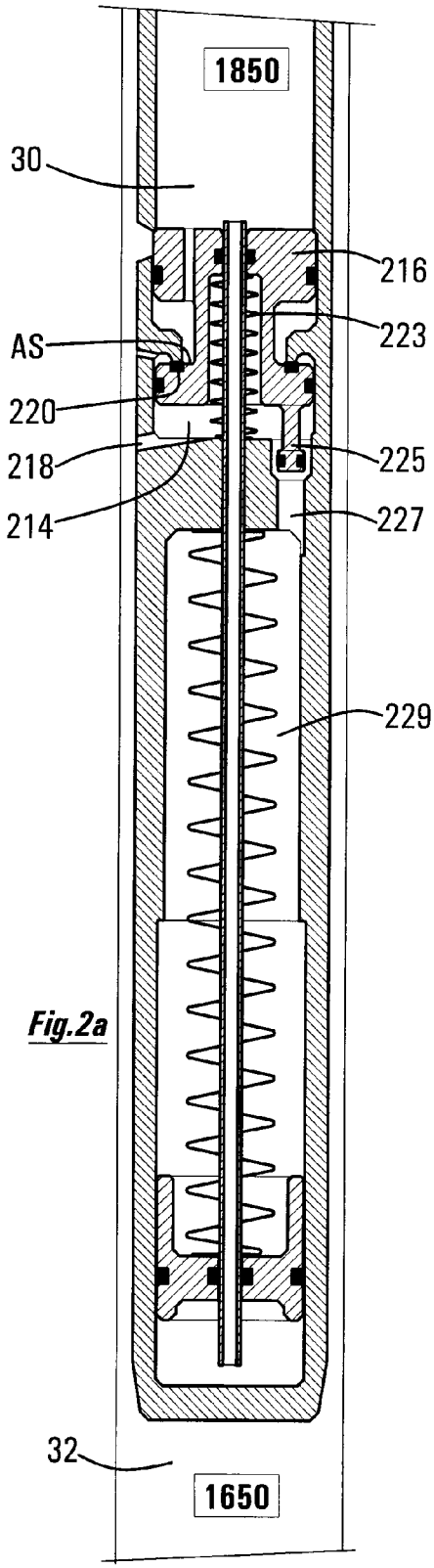

In FIG. 2*a*, the pulse-valve has closed. The closing of the pulse-valve marks the end of the injection-phase and the beginning of the recharge-phase of the pulse-cycle. The PDAF is at its low-threshold, i.e the accumulator-pressure has dropped to its lowest level, and the formation-pressure has risen to its highest level. The pulse-valve being now closed, the accumulator-pressure rises as the accumulator is recharged, and the formation-pressure falls as the just-injected liquid dissipates into the ground formation.

In FIG. 2*a*, the space 214 below the pulse-valve-piston 216 is at formation-pressure via the port 218. The space above the pulse-valve-piston 216 is at accumulator-pressure. Thus the pulse-valve-piston 216 experiences the accumulator-pressure pressing downwards over the (small) area-AS, which is the area inside the face-seal 220. At the same time, the pulse-valve-piston 216 experiences the formation-pressure pushing upwards over the full area-AF of the pulse-valve-piston. The pulse-valve-piston 216 also experiences the biassing-force of the pulse-valve-spring 223, pushing upwards.

The pulse-valve-piston 216 starts to move downwards when the PDAF has risen to its high-threshold. Now, as soon as the pulse-valve-piston 216 starts to move, the face-seal 220 cracks open, and suddenly the full area-AF of the valve-piston 216 is exposed to the accumulator-pressure. Therefore, the pulse-valve-piston 216 slams downwards, and the pulse-valve opens, and liquid from the accumulator-space 30 flows out into the formation through the now-opened pulse-valve port 210.

The end of the injection-phase of the pulse-cycle (and the start of the recharge-phase) occurs as the PDAF falls to its low-threshold level. At this low level of the PDAF, the PDAF acting on the pulse-valve-piston 216 is overcome by the pulse-valve-spring 223, and so the pulse-valve-piston 216 rises.

The low-threshold of the PDAF can be expressed by equating the upwards forces on the pulse-valve-piston with the downwards forces, as the PDAF at which:

downwards force=accumulator pressure×area-*AF*; and upwards force=(formation-pressure×area-*AF*)+spring-force.

Equally, the high-threshold of the PDAF can be expressed as the PDAF at which:

downwards force=accumulator pressure×area-*AS*; and upwards force=(formation-pressure×area-*AF*)+spring-force.

Thus, the designer can pre-determine the high-threshold and the low-threshold levels of the PDAF by suitably selecting the magnitudes of area-AF, of area-AS, and of the pulse-valve-spring 223.

The suckback operation in FIGS. 2,2*a* may be described as follows.

The pulse-valve-piston 216 carries a plug 225. The plug 225 carries a seal, by means of which, when the plug is inserted into a suckback-port 227 (FIG. 2*a*), the port 227 is closed. When the suckback-port 227 is open (FIG. 2*a*), the suckback-chamber 229 is connected to the formation-pressure, via the port 218.

A suckback-equalization level of the PDAF is the PDAF level at which, the suckback-port 227 being open, the PDAF-force acting upwards on the suckback-piston 230 is balanced by the biassing-force of the suckback-spring 232 acting upwards on the suckback-piston 230.

The suckback-port 227 having just opened, and the PDAF being below its suckback-equalization level, the volume of the suckback-chamber 229 increases (i.e, in FIG. 2*a*, the suckback-piston 230 is moving downwards). (Equally, when the PDAF is above its suckback-equalization level, the suckback-port 227 being open, the chamber volume decreases (piston 230 moves upwards)). The designer sets the suckback-spring 232 to exert such a biassing-force on the suckback-piston 230 that the suckback-equalization level of the PDAF is substantially below the high-threshold level of the PDAF, and is substantially above the low-threshold.

In the tool of FIG. 2, the designer has set the equalization-level of the PDAF at 400 psi, having set the high-threshold of the PDAF at 500 psi and the low-threshold at 100 psi.

The sealed plug 225, attached to the pulse-valve-piston 216, serves as a suckback-port-closer. During the injection-phase, the plug 225 closes the suckback-port 227, and thus seals off the suckback-chamber 229 from the formation-pressure. During the injection-phase, the underside of the suckback-piston 230 is acted upon by the accumulator-pressure (via the long pipe 234), while the suckback-chamber 229 above the suckback-piston 230 is at this time simply a closed chamber, which cannot change volume. Therefore, while the suckback-port 227 is closed, during the injection-phase, the suckback-piston 230 remains in its UP position, as in FIG. 2, whereby the suckback-chamber 229 remains at its minimum volume.

Meanwhile, during the injection phase, the PDAF falls, until it drops below its suckback-equalization level and then drops down further to its low-threshold (100 psi in this case). When that happens, the pulse-valve-member 216 rises, closing the pulse-valve, and opening the suckback-port 227.

At the moment the suckback-port 227 becomes unplugged, the PDAF (being 100 psi) is below its equalization level (400 psi); therefore, at that moment, the suckback-piston 230 immediately moves downwards. In other words, the suckback-chamber 229 increases in volume. Therefore, the pulse-valve being now closed and the suckback-port 227 being now open, liquid from the formation is drawn into the suckback-chamber 229. In other words, suckback takes place. The volume of liquid sucked back in from the formation may be equated to the variable volumetric capacity of the suckback-chamber 229.

So, at the beginning of the recharge-phase of the pulse-cycle, the suckback-piston 230 moves smartly downwards, sucking liquid back from the formation into the suckback-chamber 229. Then, as the recharge-phase progresses, the PDAF increases. When the PDAF has risen up to its suckback-equalization level (400 psi in this case), the suckback-piston 230 starts to move back upwards. The contents of the suckback-chamber 229 are thus emptied back into the formation, and the suckback-chamber 229 shrinks to its minimum volume. After that, the PDAF continues to rise, and eventually reaches its high-threshold (500 psi in this case), whereupon the pulse-valve slams open, and a new cycle begins.

Figure 3:
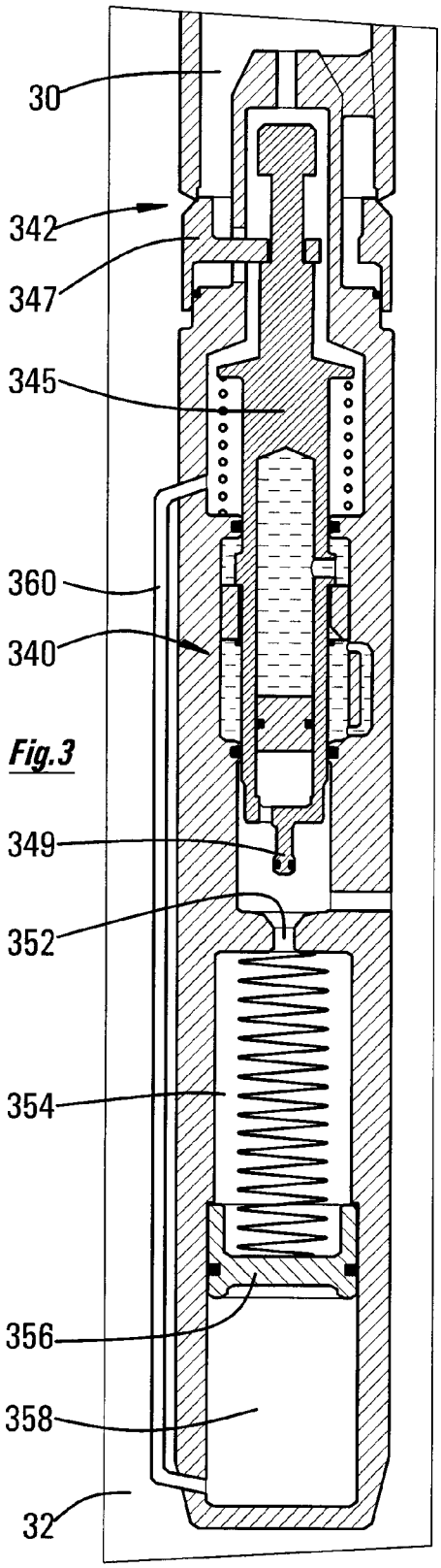
FIG. 3 is a cross-section of yet another down-hole apparatus that has been engineered to create suckback.

FIG. 3 shows a pulse-injection tool in which a dashpot mechanism 340 is used to enable the pulse-valve 342, when it opens, to open very rapidly. This tool has been provided with a separate pulse-valve-driver in the form of a hammer-piston 345, for operating the pulse-valve member 347, and further to assist in ensuring that the pulse-valve opens very rapidly. The operation of the dashpot mechanism in conjunction with a pulse-valve is described in patent publication WO-2009/089622 (17 Jul. 2009) (859-556PC).

In FIG. 3, the hammer-piston 345 carries a suckback-port-closer in the form of a sealed plug 349. The suckback-port 352 is shown in FIG. 3 in an open condition, whereby the suckback-chamber 354 is connected to the formation via the open suckback-port 352. When the PDAF reaches its high-threshold, the hammer-piston 345 descends, thereby opening the pulse-valve 342 and closing the suckback-port 352.

The suckback-piston 356 remains in the FIG. 3 position during the injection-phase of the pulse-cycle. When the PDAF falls to its low-threshold, the hammer-piston 345 rises, closing the pulse-valve 342 and opening the suckback-port 352. The suckback-piston is now exposed to the low level of the PDAF, whereby the suckback-piston 356 moves downwards, allowing liquid to flow into the suckback-chamber 354 from the formation. The PDAF rises, after a time reaching its suckback-equalization-level. The suckback-piston 356 therefore moves upwards, emptying the suckback-chamber 354 (i.e driving the suckback-chamber 354 to its minimum volume), at which point the suckback-piston 356 is returned once more to its UP, or at-rest, FIG. 3 position. Then, the PDAF continues to rise, until it reaches its high-threshold level, at which point the hammer-piston 345 moves downwards, opening the pulse-valve 342 and closing the suckback-port 352, and a new cycle begins.

In FIG. 3, the area 358 is shown as being connected to the accumulator-space 30 by means of an outside pipe 360. Of course, in many applications, an outside pipe is contra-indicated, in which case the conduit would be run internally, e.g in the manner as shown in the other drawings.

Figure 4:
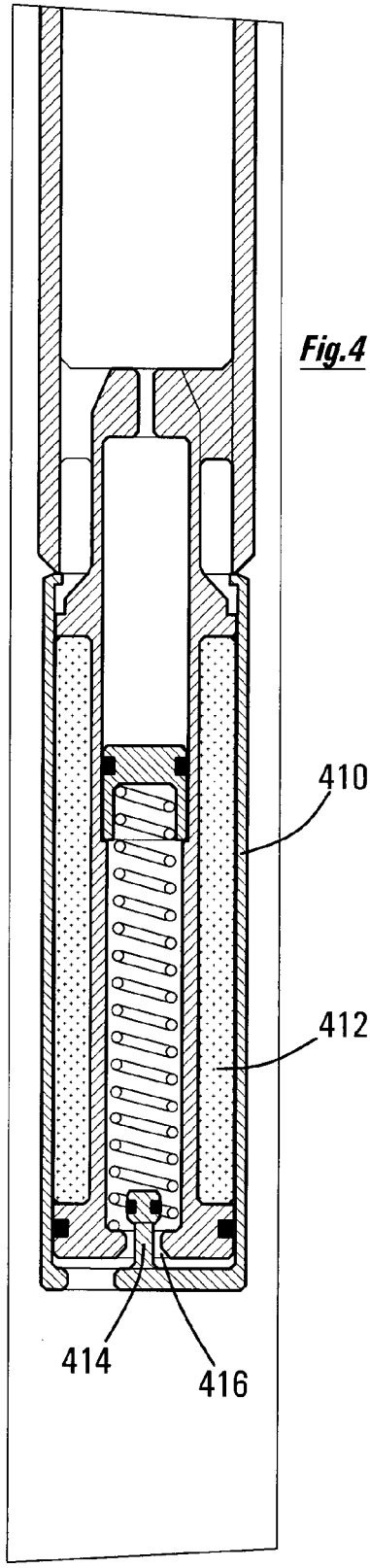
FIG. 4 is a cross-section of still another down-hole apparatus that has been engineered to create suckback.

FIG. 4 shows how the suckback-chamber and suckback-port can be added into a pulse-injection-tool that is based on a solenoid-operated pulse-valve, of the kind as disclosed in patent publication WO-2007/100352 (7 Sep. 2007) (859-42PC). In FIG. 4, the pulse-valve-member 410 is moved between its open and closed positions by a solenoid 412. The solenoid is powered by electrical conductors (not shown) that extend down from the surface. The solenoid is triggered on and off e.g by signals derived from pressure sensors. In the previous designs, the pulse-valve-motor that opens and closes the pulse-valve has been based on the pulse-valve piston/cylinder combination, which is caused to move by the interaction between the PDAF and the pulse-valve-biassing-spring. In FIG. 4, the pulse-valve-motor is based on the solenoid. The pulse-valve may be spring-loaded, to bias it open or closed, or the tool may include two solenoids, one to open the pulse-valve and the other to close it.

In FIG. 4, a sealed plug 414 seals the suckback-port 416 closed when the pulse-valve-member 410 is in its DOWN position and the pulse-valve is open. The suckback-port 416 is open when the pulse-valve-member 410 is in its UP position, as in FIG. 4. The operation of the suckback sub-cycle will be understood from the descriptions of the previous tools.

The operation of the suckback sub-cycle may be further described generally as follows. Preferably, for proper suckback functioning, the suckback-equalization-level of the PDAF should be partway between the high-threshold and the low-threshold levels of the PDAF. For example, where the PDAF high-threshold (at which the pulse-valve opens) is 500 psi, and the PDAF low-threshold (at which the pulse-valve-closes) is 100 psi, the suckback-equalization-level of the PDAF is 400 psi. If the suckback-equalization-level were set to a level below the low-threshold, it would not be so simple to engineer the suckback-chamber to expand, and to suck in the liquid from the formation. If the suckback-equalization-level were set to a level above the high-threshold, it would not be so simple to engineer the suckback-chamber to empty, after the suckback itself.

Towards the end of the injection-phase of the pulse-cycle, the PDAF is falling, and is nearing its low-threshold level. The PDAF is now below its suckback-equalization-level, and so, at this point, the designer should ensure that the suckback-port is, and stays, closed; if the PDAF were allowed to go below its equalization-level with the suckback-port open, the biassing-spring would expand the suckback-chamber, and liquid would flow into and fill the suckback-chamber; therefore, the suckback-chamber would not be empty and ready to suck in liquid from the formation when the pulse-valve closed. The suckback-port should only be opened when the pulse-valve has closed.

The following conditions should be noted, as to the opening and closing of the suckback-port. The four conditions occur in the order stated, and repeat cyclically, i.e:

1. the pulse-valve is open, and the (falling) PDAF is above its suckback-equalization level;
2. the pulse-valve is open, and the (falling) PDAF is below its suckback-equalization level;
3. the pulse-valve is closed, and the (rising) PDAF is below its suckback-equalization level;
4. the pulse-valve is closed, and the (rising) PDAF is above its suckback-equalization level.

During conditions 1 and 4, if the suckback-port is open, the suckback-spring will draw liquid into the suckback-chamber, against the low PDAF. During conditions 2 and 3, if the suckback-port is open, the high PDAF will force liquid out of the suckback-chamber, against the suckback-spring.

During condition 1, the suckback-port (which connects the suckback-chamber to the formation) should remain open long enough to allow a suckback-volume of liquid from the formation to be sucked into the suckback-chamber.

During conditions 2 and 3, the suckback-port should remain open long enough for the liquid in the suckback-chamber to be emptied or discharged back into the formation. The suckback-port can be closed once the suckback sub-cycle has been completed, or the suckback-port can remain open throughout conditions 2 and 3.

During condition 4, the suckback-port should be closed, and should remain closed until the pulse-valve opens. If the suckback-port were to be opened during condition 4, liquid would be drawn into the suckback-chamber: this would not matter, provided the suckback-chamber is empty (i.e at its minimum volume) at the moment when the pulse-valve closes, so that suckback from the formation can occur at that moment.

In the examples, the suckback-port opens when the pulse-valve closes. Then, the pulse-valve remains open until triggered to close by the PDAF rising above the equalization-level of the PDAF.

One option that might be available to designers is to provide a solenoid or similar mechanism in the tool, and to open and close the suckback-port by means of electrical signals and electrical power supplied from the surface. An electrically-energized system would offer great flexibility as to the timing of the triggering of the opening and closing of the suckback-port. However, many designers try to avoid the need to supply electrical power and signals from the surface, down to the pulsing tool.

In terms of what mechanically self-actuating triggers might be available to the designers, to actuate the opening and closing of the suckback-port, the movement of the pulse-valve-member (or of the pulse-valve-member-driver) is a prime candidate—especially from the standpoint of simplicity of operation. The examples make it clear just how simple it is to use the open/close movements of the pulse-valve to close/open the suckback-port. However, that is not to rule out that other triggers are available, or could be provided. In the case of other triggers, the designers should see to it that the open/close triggers that activate the opening and closing of the suckback-port comply with the above considerations regarding the four conditions.

The pulse-injection tool includes a pulse-valve-member and a pulse-valve-driver, which are movable relative to a pulse-valve-housing in the direction to open and close the pulse-valve. The tool also includes a pulse-valve-motor, which provides the motive power needed to move the driver. The pulse-valve-member and the pulse-valve-driver are connected together by a pulse-valve-connector. When the pulse-valve-member and the pulse-valve-driver are operable only as a single unit, the pulse-valve-connector would then be the unity thereof.

When the member and the driver are separate components, and are movable relative to each other, the pulse-valve-connector connects the driver to the member. During travel of the driver in the direction either to close or to open the pulse-valve, the connector constrains the member, over at least a portion of that travel, to move in unison with the driver. Typically, the connector includes a lost-motion capability, in that the driver picks up the member, and the member is carried along with the driver, but over only a portion of the total travel of the driver.

The tool includes an operable pulse-valve-motor, which is effective, when operated, to move the pulse-valve-driver. In FIGS. 1,2,3, the motor is powered and controlled by hydraulic pressure-differentials, and by mechanical springs. In FIG. 4, the motor is a solenoid mechanism, powered by electricity. The pulse-valve-motor is the source of the mechanical effort needed to move the pulse-valve in the direction to close the pulse-valve responsively to the PDAF reaching a low-threshold, and to move the pulse-valve in the direction to open the pulse-valve responsively to the PDAF reaching a high-threshold.

Some of the preferred features will now be described, as to the structure of the pulse-injector tool that makes the tool suitable for use with the suckback facility as described herein.

Preferably, the tool is so arranged that, during operation, the tool being supplied constantly with pressurized fluid from the surface, the accumulator-pressure is always greater than the formation-pressure, whereby the PDAF is always a positive quantity.

Preferably, the tool is so structured that the pulse-valve is operable cyclically between a pulse-valve-open position and a pulse-valve-closed position. In the pulse-valve-open position, which defines an injection-phase of the cycle, fluid can flow out through the pulse-valve, out of the tool, and into the ground formation, whereby the PDAF is then falling. In the pulse-valve-closed position, which defines a recharge-phase of the cycle, the closed pulse-valve isolates the accumulator from the formation, whereby the PDAF is then rising.

Preferably, the tool is so structured that the pulse-valve closes, to end the injection-phase of the cycle and begin the recharge-phase, when the PDAF falls to a low threshold, whereupon the PDAF starts to rise, and is so structured that the pulse-valve opens, to end the recharge-phase and begin the injection-phase, when the PDAF rises to a high threshold, whereupon the PDAF starts to fall.

Preferably, the tool is so structured as to cycle automatically, upon being supplied with fluid at nominally constant pressure. (In fact, usually, the injection pressure, measured at the surface, will vary cyclically. But this variation is a result of the cyclic operations taking place below ground. The pulsing operation itself does not require the supply pressure of the fluid to be varied cyclically.) Preferably, the cyclic operation of the tool is energized by the on-going supply of pressurized fluid from the surface, and, apart from that, no other energy-transmitting connection is made, downhole, to the tool, during operation.

It is not essential that suckback must take place every pulse-cycle, in order to be useful. For example, if the engineers were to arrange for suckback to take place every other cycle, that might well be just as effective to procure the homogenization as described.

The skilled designers will understand that the drawings are merely diagrammatic—particularly in that many of the components cannot, as drawn, be assembled together. Of course, some of the components have to be made in separate pieces, and assembled together, in order to function in the manner as described. This is within the competence of the skilled designer of down-hole moving-parts tools. Also, the drawings are not to scale; in particular, many of the vertical dimensions have been shortened. (The tool can be put to use in e.g an angled, or even horizontal, borehole—and the "up" and "down", etc, designations should be construed accordingly.)

The variable volume portion of the suckback-chamber, in a typical case, might be e.g ten liters. In order for the cyclic suckback volume to be large enough to be a worthwhile contribution to homogenizing the ground formation, the variable volume should be no less than about one liter. The suckback-biassing-spring should exert a reasonably constant force over the stroke length of the suckback-piston—in other words, the spring should have a low rate. Thus, the length of the suckback-spring, when compressed, preferably should be double the stroke length of the piston, or more.

The term "fluid" as used herein includes liquids, and includes liquids in which some gases may be entrapped or entrained. Typically, the liquids being injected will contain also some suspended solids, which may be (undesired) dirt or (desired) additives. Although use of the new technology for the injection of a gas, as such, is not ruled out of the patent protection sought herein, it is not suggested that the same injection-tool that has been engineered to work with a liquid could be simply utilized to work with a gas.

The designer should select the materials for use in the apparatus on the basis that they are suitably inert with respect to the substances likely to be encountered in the down-hole environment, over the intended service life of the apparatus.

The invention claimed is:

1. Tool for pulse-injecting fluid into the ground formation around a borehole or well, wherein:

the tool includes an accumulator, containing pressurized fluid to be injected;

the pressurized fluid is at accumulator-pressure, and fluid in the ground formation is at formation-pressure;

the difference between the accumulator-pressure and the formation-pressure is termed the PDAF;

the tool includes a pulse-valve, which cyclically opens and closes a fluid path between the accumulator and the formation;

the PDAF rises when the pulse-valve is closed and the accumulator is being recharged, and the PDAF falls when the pulse-valve is open and fluid is being injected into the formation;

the tool includes a pulse-valve-member and a pulse-valve-driver, which are movable relative to a pulse-valve-housing in the direction to open and close the pulse-valve;

the tool includes a pulse-valve-connector, which connects the driver to the member;

the pulse-valve-connector is so configured that, during travel of the driver in the direction either to close or to open the pulse-valve, the pulse-valve-connector constrains the pulse-valve-member, over at least a portion of that travel, to move in unison with the pulse-valve-driver;

the tool includes an operable pulse-valve-motor;

the motor is effective, when operated, to move the pulse-valve-driver in the direction to close the pulse-valve responsively to the PDAF reaching a low-threshold, and to open the pulse-valve responsively to the PDAF reaching a high-threshold;

the tool includes a suckback-cylinder and a relatively movable sealed suckback-piston, which together define a suckback-chamber of variable volumetric capacity;

the suckback-piston is mechanically free with respect to both the pulse-valve-driver and the pulse-valve-member, in that the suckback-piston is free to travel along the suckback-cylinder without physically touching, and without being constrained by, either the pulse-valve-driver or the pulse-valve-member;

the tool is so configured that the distance the suckback-piston travels along the suckback-cylinder, during a cycle, is substantially greater than the distance the pulse-valve-driver travels relative to the pulse-valve-housing, during the cycle;

the suckback-cylinder includes an openable suckback-port;

the suckback-port, when open, connects the suckback-chamber to the formation;

the tool is so configured that, when the suckback-port is closed, the suckback-chamber is sealed off from the formation;

the tool is so configured that, when the suckback-port is open, the PDAF exerts a PDAF-force on the suckback-piston in the direction to decrease the volume of the suckback-chamber;

the tool includes a suckback-biasser, which exerts a biassing-force on the suckback-piston in the direction to increase the volume of the suckback-chamber;

a suckback-equalization level of the PDAF is the level at which, the suckback-port being open, the PDAF-force on the suckback-piston is balanced by the biassing-force on the suckback-piston;

the suckback-biasser provides a biassing-force of such magnitude that the suckback-equalization level of the PDAF is substantially above the said low-threshold of the PDAF.

2. The tool as in claim 1, wherein:

the tool is so structured as to cycle automatically, upon being supplied with pressurized fluid from the surface;

the cyclic operation of the tool is activated and powered by the supply of pressurized fluid from the surface; and apart from that supply, no other energy-transmitting connection is made, downhole, to the tool, during operation.

3. The tool as in claim 1, wherein:

the pulse-valve-driver includes a pulse-valve-piston, which is sealably slidable in a pulse-valve-cylinder;

the pulse-valve-motor is so configured that the pulse-valve-piston is exposed to accumulator-pressure on one side and formation-pressure on the other side, whereby the pulse-valve-piston is urged to move by the PDAF in such direction as to open the pulse-valve;

the pulse-valve-motor includes a pulse-valve-biasser, which exerts a biassing-force between the pulse-valve-piston and the pulse-valve-cylinder, to urge the pulse-valve-piston in such direction as to close the pulse-valve.

4. The tool as in claim 1, wherein the pulse-valve-driver includes a solenoid, powered by electricity from the surface.

5. The tool as in claim 1, wherein:

the tool includes an operable suckback opening-trigger;

the opening-trigger is effective, when operated, to open the suckback-port;

the opening-trigger is operable responsively to the closing of the pulse-valve.

6. The tool as in claim 1, wherein:

the tool includes an operable suckback-opening-trigger;

the opening-trigger is effective, when operated, to open the suckback-port;

the opening-trigger is operable responsively to the PDAF reaching its low-threshold level.

7. The tool as in claim 1, wherein:

the suckback-port, when in its open position, is wide open;

in that the open suckback-port allows fluid to flow from the formation and into the suckback-chamber substantially without restriction.

8. The tool as in claim 1, wherein the suckback-biasser provides a biassing-force of such magnitude that the suckback-equalization level of the PDAF is substantially below the said high-threshold of the PDAF.

9. The tool as in claim 1, wherein:

the tool includes an operable suckback-closing-trigger;

the tool is so arranged that the suckback-closing-trigger operates to close the suckback-port at a point in the cycle when the PDAF is above its equalization level.

10. The tool as in claim 1, wherein:

the suckback-port includes a movable suckback-port-closer;

the pulse-valve includes a movable pulse-valve-member;

the pulse-valve-member is connected to the suckback-port-closer in such manner that:

when the pulse-valve opens, the suckback-port closes; and when the pulse-valve closes, the suckback-port opens.

11. The tool as in claim 1, wherein:

the chamber-walls of the suckback-chamber include a movable wall, which is movable in such manner as to change the volume of the suckback-chamber;

the movable wall is exposed on its inside to pressure of fluid within the suckback-chamber;

the movable wall is exposed on its outside to accumulator-pressure;

whereby, when the suckback-chamber-port is open, the suckback-chamber then being open to the formation, the PDAF creates a PDAF-force acting upon the movable-wall in the direction to decrease the volume of the suckback-chamber;

the tool includes a suckback-biassing-means, which is effective to exert a biassing-force on the movable wall in the direction to increase the volume of the suckback-chamber, against the PDAF;

an equalization level of the PDAF is the level at which, the suckback-chamber-port being open, the PDAF-force on the movable wall is balanced by the biassing-force on the movable wall;

whereby, the suckback-chamber-port being open, when the PDAF is below its equalization level, the chamber volume increases; and when the PDAF is above its equalization level, the chamber volume decreases.

12. The tool as in claim 1, wherein:

the tool includes an operable pulse-valve-opening-trigger, which is effective, when operated, to open the pulse-valve;

the pulse-valve-opening-trigger is operable in response to the PDAF rising to a high-threshold;

the tool includes an operable pulse-valve-closing-trigger, which is effective, when operated, to close the pulse-valve;

the pulse-valve-closing-trigger is operable in response to the PDAF falling to a low-threshold.

13. The tool as in claim 1, wherein:

the tool is so arranged that the pulse-valve opens and closes cyclically;

the tool includes a pulse-valve-piston, which is sealed into, and movable relative to, a complementary pulse-valve-cylinder;

the pulse-valve-piston is exposed on one side to the accumulator-pressure, and on its opposite side to the formation-pressure, whereby the piston is exposed to the PDAF;

the tool is so arranged that the PDAF acts on the pulse-valve-piston in such manner as to urge the pulse-valve open;

the tool includes a pulse-valve-biasser, for example a spring;

the tool is so arranged that the pulse-valve-biasser acts on the pulse-valve-piston in the direction to urge the pulse-valve closed.

* * * * *